United States Patent [19]

Whipps

[11] 4,439,061

[45] Mar. 27, 1984

[54] ALUMINUM STOPLOGS

[75] Inventor: George E. Whipps, Athol, Mass.

[73] Assignee: Whipps, Inc., Athol, Mass.

[21] Appl. No.: 348,802

[22] Filed: Feb. 16, 1982

[51] Int. Cl.[3] ..... E02B 7/36; E02B 7/54

[52] U.S. Cl. ..... 405/104; 405/106

[58] Field of Search ..... 405/87, 90, 104, 105, 405/106, 114; 49/460

[56] References Cited

U.S. PATENT DOCUMENTS 1,618,545 2/1927 Mann ..... 405/105

2,131,052 9/1938 Kinzie et al. ..... 405/105

2,683,354 7/1954 Harza ..... 405/104

3,514,904 6/1970 Riegelman ..... 49/460

*Primary Examiner*—David H. Corbin

*Attorney, Agent, or Firm*—Schiller & Pandiscio

[57] ABSTRACT

A new and improved type of aluminum stoplog for use in stoplog gates. The stoplog is made of extruded channel members, has lifting hooks on its top end to facilitate removal, and has a recessed region running along its bottom end to accommodate the lifting hooks of an adjacent and lower stoplog of like design. The stoplog also includes improved sealing means about a part of its perimeter.

8 Claims, 3 Drawing Figures

ALUMINUM STOPLOGS

FIELD OF THE INVENTION

This invention relates to gate mechanisms in general, and more particularly to a new and improved type of aluminum stoplog for use in stoplog gates.

BACKGROUND OF THE INVENTION

Stoplog gates are not new in the art. Such gates have long been used to selectively open up or close off a channel to a flow of water. Stoplog gates typically comprise a log-retaining frame having a pair of vertical grooves formed opposite one another in the two opposing side walls of a flow channel, and a variable number of stoplogs which slidably fit into the vertical wall grooves so that each stoplog extends across the channel between the two opposing side walls in a direction perpendicular to the flow of water. With this arrangement the first stoplog introduced into the vertical side grooves slides down along the grooves until it comes to rest on the bottom surface of the channel, and any additional stoplogs subsequently introduced into the vertical side grooves stack one upon another. In this way the stoplogs, in combination with the bottom surface of the channel and the side walls of the channel, form a barrier to the flow of water. By varying the number of stoplogs used in the gate, and also the height of the stoplogs used in the gate, the level of the stoplog barrier within the channel can be regulated as desired.

Early stoplog members were typically formed of logs or simple wooden planks. Later steel and/or concrete beams were also employed as stoplogs. However, since the height of the water barrier in a stoplog gate can only be adjusted by the addition or removal of stoplogs into and out of the vertical grooves formed in the side walls of the channel, it has been found desirable to have the stoplogs formed out of the lightest possible materials in order to facilitate manipulation of the stoplogs. At the same time, however, it has also been found desirable to make the stoplogs as strong as possible so that the stoplogs may adequately resist the force of the water in the channel, and also so that the stoplogs may survive any possible collisions with foreign objects which may be carried along by the water. As a result, efforts have been made to fabricate relatively strong stoplogs out of strong, lightweight materials such as aluminum.

One well-known stoplog design calls for fabricating the stoplogs out of large, thin plates of aluminum attached to and strengthened by an interior aluminum support structure. However, making this type of stoplog tends to be time-consuming and expensive. In addition, the large thin plates of aluminum have exhibited a tendency to become distorted while they are being attached to the interior support structure. Such plate distortion can create problems with introducing or removing stoplogs into or out of the stoplog gate, and may also impede the formation of a watertight barrier by the stoplogs across the channel.

Another known stoplog design addresses these distortion problems by providing an aluminum stoplog which comprises two or more channel-shaped members of extruded aluminum, wherein the two or more members are stacked vertically and parallel on one another and then attached together, e.g., by welding, so as to form a single rigid stoplog of substantially rectangular cross-section, with at least one of the vertical faces of the stoplog being substantially impervious to water.

The uppermost member includes at least one mounting hook thereon for coupling the stoplog to stoplog lifting and lowering means, and the lowermost member includes at least one drilled hole for receiving the at least one mounting hook of an adjacent and lower stoplog when a plurality of stoplogs are stacked one above another in a stoplog gate, in order that the presence of the one or more lifting hooks on the top side of the lower stoplog will not impede the formation of a watertight seal between adjacent stoplogs when a plurality of stoplogs are stacked in a stoplog gate. Sealing means, in the form of J-type seals, are also provided about the perimeter of the stoplog to insure a good watertight seal when the stoplog is positioned within the stoplog gate. The seals are mounted to the stoplog by attaching an aluminum strip to a portion of each seal and then bolting the strip to the stoplog using conventional nuts and bolts.

Unfortunately, while such an extruded stoplog design solves the aforementioned distortion problems encountered with other aluminum stoplogs, it has its own set of disadvantages. First, the attachment of the seals to their aluminum mounting strips takes time and effort. Second, the subsequent bolting of the seals to the stoplog involves another time-consuming step in the manufacturing process. Third, the use of J-type seals in the stoplog design means that it is necessary to miter the bulb sections of two perpendicularly-adjoining seals in order to provide a watertight fit between the seals. Fourth, the use of aluminum mounting strips on the seals means that they too must be mitered where seals adjoin one another in order to provide the requisite watertight fit. And fifth, the drilling of holes in the extruded lowermost channel member (to receive the mounting hooks of an adjacent and lower stoplog) means that another time-consuming step is added to the manufacturing process. Furthermore, by using discrete drilled holes to receive the mounting hooks, the stoplog design necessitates that the positions of the mounting hooks and the receiving holes be carefully coordinated with one another to assure proper reception of the mounting hooks within the holes. This means that more time may be required in this stage of the manufacturing process.

OBJECTS OF THE PRESENT INVENTION

As a result, the principle object of the present invention is to produce an aluminum stoplog which is strong, light in weight, easy to produce, and does not suffer any distortion problems during manufacture.

A second object of the present invention is to provide a stoplog which includes lifting hooks on the top side thereof to facilitate insertion and withdrawal of the stoplog into and out of the stoplog gate.

A third object is to provide a recessed region running along the bottom side of the stoplog which is capable of accommodating the lifting hooks of an adjacent and lower stoplog regardless of the positioning of the lifting hooks on the lower stoplog, in order that the presence of lifting hooks on the top side of the lower stoplog will not impede a watertight seal between adjacent stoplogs when a plurality of stoplogs are stacked in a stoplog gate.

A fourth object of the present invention is to provide a stoplog which has improved but relatively low cost sealing means carried thereon so as to (a) better assure that the one or more stoplogs used in a stoplog gate will be able to provide a substantially watertight barrier to the flow of water within the channel, and (b) allow simpler and more economical attachment of the sealing means to the stoplog.

SUMMARY OF THE PRESENT INVENTION

These and other objects of the present invention are addressed by providing a novel type of aluminum stoplog which comprises two or more channel-shaped members of extruded aluminum, wherein the two or more members are stacked vertically and parallel on one another and then attached together, e.g. by welding, so as to form a single rigid stoplog of substantially rectangular cross-section, with at least one of the vertical faces of the stoplog being substantially impervious to water. The uppermost member preferably includes at least one mounting hook thereon for coupling with stoplog lifting and lowering means, and the lowermost channel member includes a recessed region running along the bottom side of the member for receiving the at least one mounting hook of an adjacent and lower stoplog when a plurality of stoplogs are stacked one above another in a stoplog gate, in order that the presence of lifting hooks at any particular point on the top side of the lower stoplog will not impede a watertight seal between adjacent stoplogs when a plurality of stoplogs are stacked in a stoplog gate. Sealing means are also provided on one side of the stoplog to insure a good watertight seal when the stoplog is positioned within the stoplog gate. The sealing means comprise rectangular rubber strips received in grooves formed in the stoplog, in order that attachment of the strips to the stoplog will be facilitated and also so that the strips may make watertight junctions with one another.

BRIEF DESCRIPTION OF THE DRAWINGS

Still other objects and features of the present invention will be made apparent in the following detailed description of the preferred embodiment, which is to be considered together with the accompanying drawings wherein like numbers refer to like parts, and further wherein.

DETAILED DESCRIPTION OF THE PREFERRED EMBODIMENT

Figure 1:
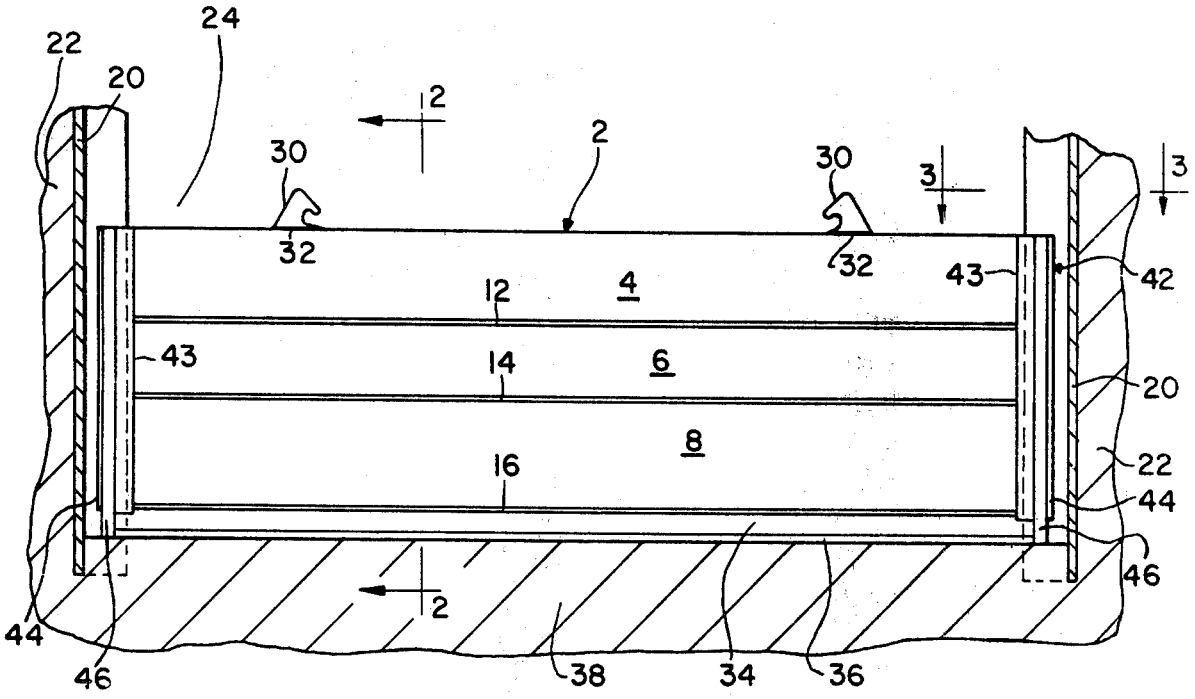
FIG. 1 is a front elevation partly in section of a stoplog gate utilizing a single aluminum stoplog made in accordance, with the present invention.
Figure 3:
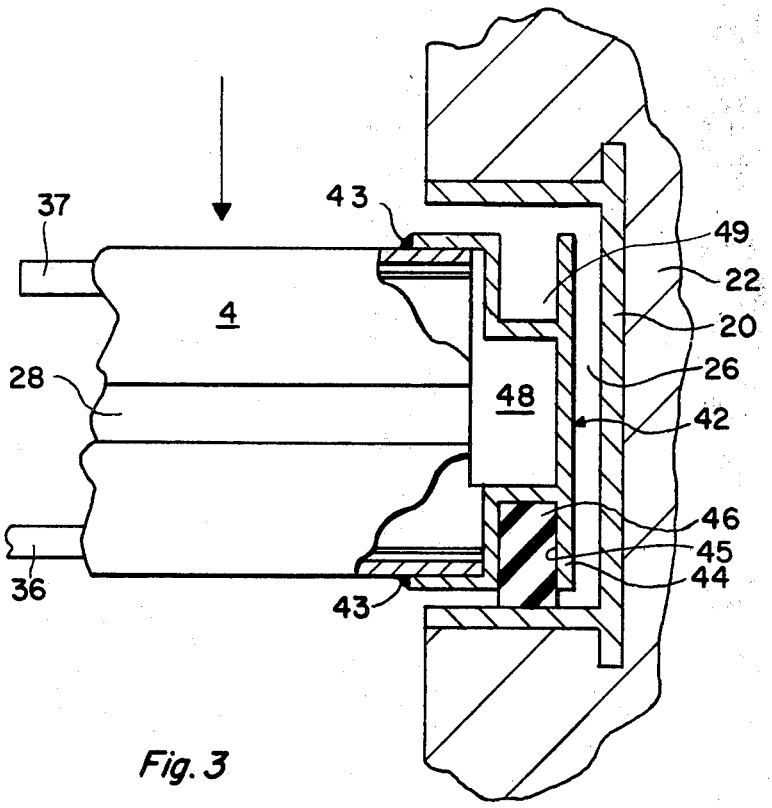
FIG. 3 is a fragmentary top view, partly in cross-section, taken along line 3—3 of FIG. 1, with the upstream-downstream flow of water being designated by the arrow shown in the drawing.
Figure 2:
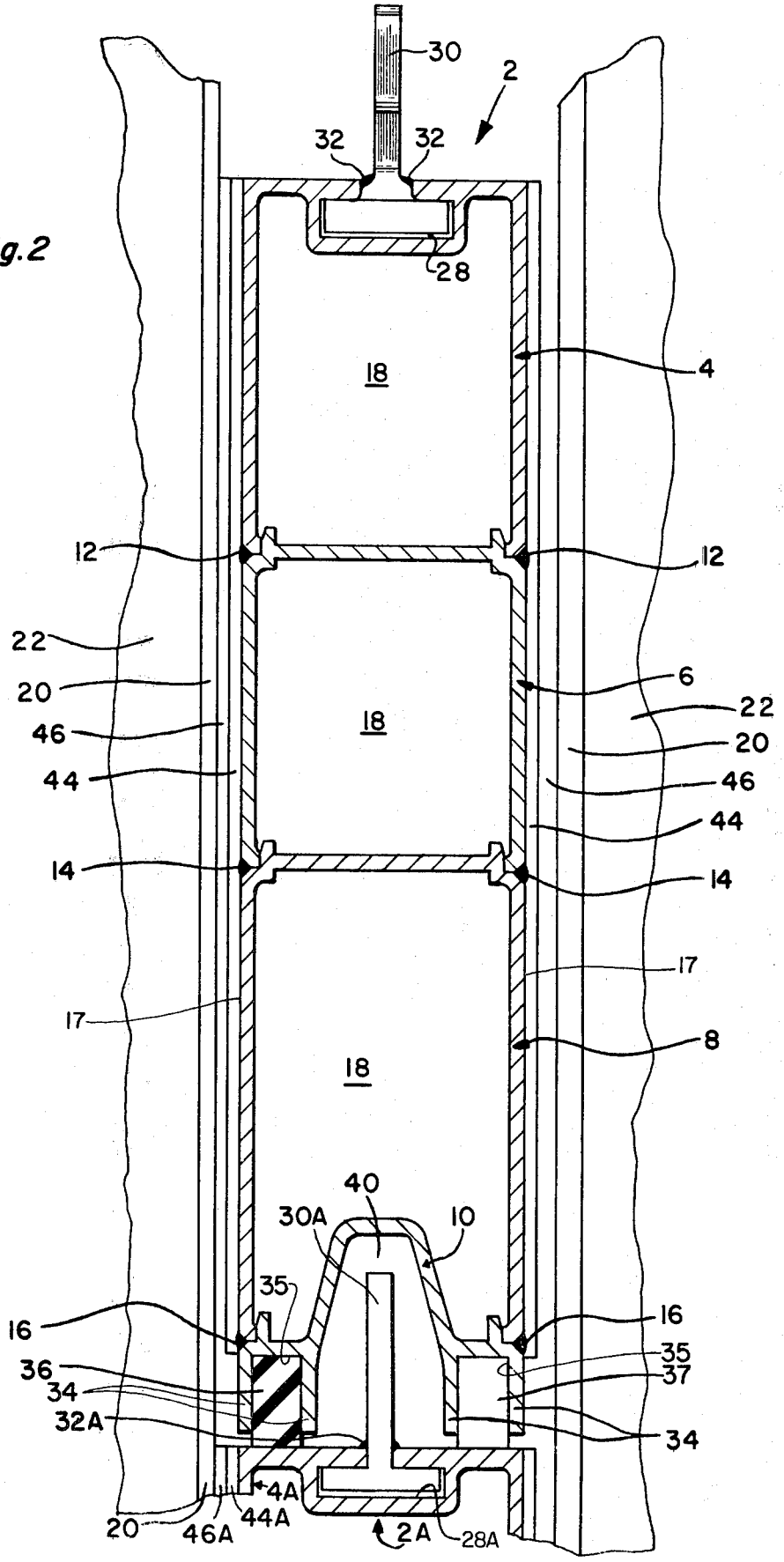
FIG. 2 is a cross-sectional view taken along line 2—2 of FIG. 1, except that the floor of the channel has been removed and the top portion of a second stoplog has been added to show how adjacent stoplogs cooperate with one another when stacked to form a stoplog gate.

The preferred form of the invention is shown in FIGS. 1–3. As seen in FIGS. 1 and 2, the stoplog 2 generally comprises an upper U-shaped channel member 4, a middle U-shaped channel member 6, a lower U-shaped channel member 8, and a lower end cap channel member 10. Channel members 4, 6, 8 and 10 are all preferably formed of extruded aluminum stock. Upper channel member 4 is joined to middle channel member 6 by a pair of continuous welds 12, middle channel member 6 is joined to lower channel member 8 by a pair of continuous welds 14, and lower channel member 8 is joined to lower end cap channel member 10 by a pair of continuous welds 16. In this way channel members 4, 6, 8 and 10 reinforce one another so as to form a single rigid body of substantially rectangular cross-section which contains a plurality of horizontal interior cavities 18. At least one, and preferably both, of the two vertical faces 17 of the single rigid body formed from the welded channel members 4, 6, 8 and 10 are substantially impervious to water. Channel members 4, 6, 8 and 10 are all formed of substantially identical lengths, except as will hereinafter be pointed out in detail, and are sized so that they are all slightly shorter in length than the distance extending between the opposing vertical groove liners 20 which are set into the opposing concrete walls 22 of a water flow channel 24. At the same time, channel members 4, 6, 8 and 10 are formed with substantially identical widths, and are sized so that they are all slightly less in width than the widths of the grooves 26 which are defined by the vertical groove liners 20.

Formed in the top surface of upper channel member 4 is a lifting hook channel 28. Channel 28 runs the length of upper channel member 4 and serves to slidably constrain a pair of lifting hooks 30. Lifting hooks 30 are preferably formed of a cast aluminum alloy and serve to receive chains or other lifting apparatus (not shown) which are used to manipulate the stoplog into or out of the stoplog gate. Lifting hooks 30 are intended to be introduced into lifting hook channel 28 at either of the two ends of upper channel member 4, and are slid along channel 28 until they are properly positioned intermediate the two ends of upper channel member 4, e.g., as shown in FIG. 1. Once lifting hooks 30 are deemed to be in their proper position along channel 28, the hooks 30 are welded into place with spot or continuous welds 32.

Lower end cap channel member 10 is provided with four support extensions 34. Extensions 34 run the length of lower end cap member 10 and, together with other portions of lower end cap member 10, define a pair of grooves 35 on the bottom end of stoplog 2. As shown in FIG. 2, one of the grooves 35 is set on the upstream side of stoplog 2 and the other of the grooves 35 is set on the downstream side of stoplog 2. The direction of water flow is indicated by the arrow in FIG. 3.

Disposed in the downstream groove 35 is a seal 36. Seal 36 is sized to run the length of lower end cap member 10 and serves to assure a substantially watertight fit between the stoplog and whatever structure resides immediately below the stoplog. Seal 36 is preferably formed of neoprene and is intended to be fixed in groove 35 by means of a suitable cement, although a simple friction fit may also be utilized to hold seal 36 in place.

Disposed in the upstream groove 35 are a pair of feet 37. Feet 37 serve to assure that stoplog 2 will remain vertically upright when its seal 36 makes contact with whatever structure resides immediately below the stoplog. To this end each of the feet 37 is sized so that it has the same cross-sectional dimensions as seal 36. However, since feet 37 serve simply as support for the stoplog, and not as sealing means as is the case with seal 36, feet 37 do not extend along the entire length of lower end cap member 10. In the embodiment shown in FIGS. 1–3, feet 37 are sized much shorter in length than seal 36 and are disposed at opposite ends of cap member 10. Preferably each foot 37 is spaced from the end edge of cap member 10. If desired three or more feet 37 may be installed in the upstream groove 36 at spaced locations.

Thus, it will be seen that, in the case where the stoplog 2 is the bottommost one in the stoplog gate (see FIG. 1), the stoplog will rest on its seal 36 and feet 37 on the concrete bottom section 38 of the channel 24, and seal 36 will form a substantially watertight seal with the concrete bottom of the channel. In the alternative situation where the stoplog is not the bottommost one in the stoplog gate, but rather seats itself on its seal 36 and feet 37 on a lower stoplog (see FIG. 2), seal 36 and feet 37 will rest on the upper channel member 4A of the next-lower stoplog 2A so that seal 36 forms a substantially watertight fit with the uppermost surface of the upper channel member 4A of that next-lower stoplog.

In the latter case, in order that the lifting hooks 30 will not interfere with a proper mounting of seal 36 and feet 37 onto the upper channel member 4 of the next-lower stoplog, each lower end cap member 10 is also provided with a recess 40 which preferably runs the length of cap member 10. Recess 40 is sized and located relative to the lifting hooks 30 such that when one stoplog is located adjacent to and above another stoplog, the lifting hooks 30A from the lower stoplog will be received in the recess 40 and seal 36 and feet 37 from the upper stoplog will seat properly on the upper channel member 4A of the lower stoplog (see FIG. 2). In this respect it will be readily appreciated that since the recess 40 runs the length of each lower end cap member 10, recess 40 will adequately receive the lifting hooks 30A regardless of where hooks 30A are positioned along the lifting hook channel 28A.

The two vertical ends of the single rigid stoplog body which is formed by the united channel members 4, 6, 8 and 10 are each fitted with a side end cap 42 (see FIGS. 1 and 3). Side end caps 42 are sized slightly wider than the widths of channel members 4, 6, 8 and 10, but are still sized slightly narrower in dimension than the width of vertical grooves 26. Each side end cap 42 is attached to channel members 4, 6, 8 and 10 by means of the two continuous welds 43. Each side end cap 42 is provided with a seal support extension 44. Each extension 44 runs the length of end cap 42 and, in conjunction with other portions of end cap 42, defines a vertical groove 45 on the downstream side of the stoplog. Each groove 45 serves to receive and support a seal 46. Seals 46 serve to assure a substantially watertight fit between the stoplog and liners 20 which define vertical grooves 26, in a manner which will hereinafter be discussed. Seals 46 are preferably formed of neoprene and are intended to be fixed in grooves 45 by means of a suitable cement. Alternatively, a simple friction fit may be used to hold seals 46 in place within grooves 45.

As shown in FIG. 1, side end caps 42 run from the top surface of upper channel member 4 to a point approximately equal in height to the top end of seal 36. At the same time, seals 46 are sized somewhat greater in length than the vertical height of side end caps 42, in order that the bottom ends of seals 46 may lie flush with the bottom surface of seal 36 and the top ends of seals 46 may lie flush with the top end surface of upper channel member 4. Seal 36 is sized such that it can properly abut with and form a watertight fit with seals 46 in order that no water can pass between seal 36 and seals 46. Seals 46 are sized relative to side end caps 42 and vertical groove liners 20 such that seals 46 can form a substantially watertight seal with the liners 20 when the stoplog 2 is placed in position within the stoplog gate and the stoplog is forced in a downstream direction by the flow of water within channel 24. At the same time, however, seals 46 are sufficiently sized relative to side end caps 42 and groove liners 20 so that a stoplog 2 can be easily moved up and down within the vertical grooves 26 of the stoplog gate.

Each side end cap 42 also coordinates with channel members 4, 6, 8 and 10 so as to provide a vertical interior cavity 48 (see FIG. 3). Vertical interior cavities 48 communicate with horizontal interior cavities 18. Vertical cavities 48 allow the horizontal cavities 18 to be flooded with water during installation, in order that the stoplog may be more easily seated in the gate. In addition, cavities 48 allow the horizontal cavities 18 to drain during withdrawal of the stoplog, thus lightening the weight of the stoplog.

Thus it will be apparent to one skilled in the art that when a first stoplog 2, made in accordance with the preferred embodiment, is lowered into the stoplog gate's vertical grooves 26, the stoplog will drop to the bottom of the grooves so that its seal 36 and feet 37 and the bottom ends of seals 46 seat securely on the bottom section 38 of the channel 24 and form a watertight seal therewith. At the same time, seals 46 will form a watertight seal with vertical groove liners 20 as the flow of water in channel 24 forces the stoplog toward the downstream sides of liners 20. In this way no water will be able to pass by the stoplog 2 so long as the level of the water in channel 24 is below the uppermost surface of upper channel member 4. If the height of the water in channel 24 is greater than the height of a single stoplog 2, and one desires to stop the flow of water within the channel, additional stoplogs can be added to the stoplog gate in the manner previously described. As pointed out above, such additional stoplogs will mate to one another so as to provide a substantially watertight barrier to the water.

MODIFICATIONS AND OTHER ADVANTAGES OF THE PREFERRED EMBODIMENT

It will be readily appreciated by one skilled in the art that various modifications may be made to the preferred embodiment without departing from the scope of the present invention. Thus, for example, one might choose to form channel members 4, 6 and 8 in a shape other than U-shaped, e.g. as square or rectangular box sections.

Alternatively, one might elect to use more or fewer extruded channel members than the four used in the preferred embodiment. Also contemplated are seals which have other cross-sectional shapes yet have substantially flat surfaces engaging the sides of the grooves in the channel members and the confronting surfaces of the groove liners 20. By way of example the seals 46 may be T-shaped in cross-section, with the head of the T engaging the adjacent liner 20.

The stoplogs also may be made of a material other than aluminum, e.g., steel.

It is also contemplated that one might use a means other than welding, e.g. cementing, to secure the extruded channel members to one another.

Still another modification could involve disposing another seal 46 in the vertical groove 49 formed in each side end cap 42. By appropriately dimensioning these additional seals 46 one could assure that each stoplog gate would be snugly held in grooves 26 in liners 20 regardless of the presence of a downstream flow in channel 24.

These and other changes of their type are foreseen as obvious to one skilled in the art, and within the scope of the present invention.

In any event, the stoplogs offer the advantage of high strength, ease of manufacture and use, relatively light weight, durability, low cost replaceable seals, and water tight association with one another.

What I claim is:

1. A stoplog for use in forming a stoplog gate, said stoplog comprising two or more parallel elongate metal members which are shaped and attached to one another so as to form a single rigid hollow structure characterized by two parallel spaced flat faces, a bottom wall, two side walls, and a top wall, with at least one of said faces being substantially impervious to water, and sealing means disposed about said at least one water-impervious face along said side walls and said bottom wall, said sealing means comprising (a) at least one bottom groove in said bottom wall, said at least one bottom groove extending along substantially the entire length of said bottom wall and being open at its bottom side, (b) at least one side groove in each of said two side walls, each of said side grooves extending along at least a part of the length of said side walls and being open in a direction perpendicular to said flat faces, and (c) a plurality of resilient strips secured in said bottom and side grooves, with portions of said strips protruding from said grooves and said protruding portions each having a generally flat surface for engaging and forming a watertight seal with adjacent surfaces when said stoplog is disposed in a log-retaining structure.

2. A stoplog according to claim 1 wherein the uppermost of said two or more metal members carries at least one lifting hook.

3. A stoplog according to claim 2 wherein the uppermost of said two or more metal members includes a channel formed in the upper side thereof and extending along substantially its entire length, said channel being adapted to receive and slidably constrain at least a first portion of said at least one lifting hook, in order that said at least one lifting hook can be moved along said second channel until it is properly positioned and then a second portion of said at least one lifting hook used to lift and lower the stoplog into and out of a stoplog gate.

4. A stoplog according to claim 2 wherein the lowermost of said two or more metal members has a recess in the lower side thereof, said recess extending along substantially the entire length of said lowermost member and being sized and positioned so as to accommodate therein the lifting hook of an adjacent, lower stoplog.

5. A stoplog according to claim 4 wherein said at least one bottom groove lies adjacent to and parallel to said recess.

6. A stoplog according to claim 5 wherein said side walls are formed by end caps attached to the opposite ends of said two or more elongate metal members.

7. A stoplog according to claim 6 wherein said members and said end caps are made of extruded aluminum.

8. A stoplog according to claim 1 wherein said bottom and side grooves are disposed relative to one another such that said plurality of resilient strips secured therein may make a sealing engagement with one another.

* * * * *